US006794964B2

(12) United States Patent
Sood et al.

(10) Patent No.: US 6,794,964 B2
(45) Date of Patent: Sep. 21, 2004

(54) BI-STABLE MICROSWITCH INCLUDING MAGNETIC LATCH

(75) Inventors: Dinesh Kumar Sood, Ringwood (AU); Ronald Barry Zmood, North Caulfield (AU); Lijiang Qin, Bentleigh (AU)

(73) Assignee: Alcatel, Paris (FR)

( * ) Notice: Subject to any disclaimer, the term of this patent is extended or adjusted under 35 U.S.C. 154(b) by 158 days.

(21) Appl. No.: 09/883,220

(22) Filed: Jun. 19, 2001

(65) Prior Publication Data

US 2002/0036555 A1 Mar. 28, 2002

(30) Foreign Application Priority Data

Jun. 20, 2000 (AU) ..... PQ8247

(51) Int. Cl.[7] ..... H01H 51/22

(52) U.S. Cl. ..... 335/78; 337/14; 337/36; 337/102; 337/298; 337/333

(58) Field of Search ..... 337/14, 36, 85, 337/102, 298, 333, 362, 377

(56) References Cited

U.S. PATENT DOCUMENTS 4,434,411 A * 2/1984 Anderson et al. ..... 335/208
4,504,809 A * 3/1985 Lueker et al. ..... 335/208
4,668,928 A * 5/1987 Davis et al. ..... 335/79
5,742,012 A 4/1998 Franzke et al.
6,236,300 B1 * 5/2001 Minners ..... 337/139
6,239,685 B1 * 5/2001 Albrecht et al. ..... 337/365
6,417,757 B1 * 7/2002 Silverbrook ..... 337/107
6,456,190 B1 * 9/2002 Andersson et al. ..... 337/365
6,480,089 B1 * 11/2002 Silverbrook ..... 337/36
6,531,947 B1 * 3/2003 Weaver et al. ..... 337/139

FOREIGN PATENT DOCUMENTS

DE 3543562 A1 6/1987
DE 3724337 A1 2/1989
DE 19814985 A1 10/1999

OTHER PUBLICATIONS

Derwent Abstract Accession No. H0474B/33, class R44, SU 630665 A (Namitokov KK) Nov. 1, 1978. Whole Document. Derwent Abstract Accession No.97–195829/199718 XRPX Accession No. N97–161786 (Nippon Telegraph & Telephone Corp) JP 8264090 A, Oct. 11, 1996, pp. 1–2.

* cited by examiner

*Primary Examiner*—Lincoln Donovan
*Assistant Examiner*—Bernard Rojas
(74) *Attorney, Agent, or Firm*—Sughrue Mion, PLLC

(57) ABSTRACT

A bi-stable microswitch (1) including a pair of contacts (4, 5) and an armature (10,11) movable between a first position and a second position to selectively break or make the pair of contacts, the armature being latched in the second position by a magnetic path including a permanent magnet (3) and a magnetizable element (7) having a first temperature, wherein the armature is resiliently biased towards the first position when latched, and is movable from the second position to the first position upon heating of the magnetizable element to above the first temperature.

18 Claims, 6 Drawing Sheets

BI-STABLE MICROSWITCH INCLUDING MAGNETIC LATCH

BACKGROUND OF THE INVENTION

The present invention relates generally to microswitch arrays and microswitch array elements for switching electrical signal lines. The invention is applicable to the switching of telecommunications signal lines and it will be convenient to hereinafter describe the invention in relation to that exemplary, non limiting application.

Switching arrays are used in telecommunication applications, when a large number of telecommunication signal lines are required to be switched. Generally, such switching arrays are provided by the permanent connection of copper pairs to "pillars" or underground boxes, requiring a technician to travel to the site of the box to change a connection.

In order to remotely alter the copper pair connections at the box without the need for a technician to travel to the site, there have been proposed switching arrays consisting of individual electro mechanical relays wired to printed circuit boards. However, this type of array is complex, requires the addition of various control modules and occupies a considerable amount of space. Further, current must be continuously provided through the relay coil in order to maintain the state of the relay. Since in many applications switching arrays elements are only rarely required to be switched, this results in an undesired power consumption.

It would therefore be desirable to provide a switching array and switching array element which ameliorates or overcomes one or more of the problems of known switching arrays.

It would also be desirable to provide a bi-stable broad band electrically transparent switching array and switching array element adapted to meet the needs of modern telecommunications signal switching.

It would also be desirable to provide a switching array and switching array element tat facilitates the remotely controllable, low power bi-stable switching of telecommunication signal lines.

SUMMARY OF THE INVENTION

With this in mind, one aspect of the present invention provides a bi-stable microswitch including a pair of contacts and an armature movable between a first position and a second position to selectively break or make the pair of contacts, the armature being latched in the second position by a magnetic path including a permanent magnet and a magnetisable element having a first Curie temperature wherein the armature is resiliently biased towards the first position when latched, and is movable from the second position to the first position upon heating of the magnetisable element to above the first Curie temperature.

Conveniently, the armature may include a fist section having a first thermal expansion coefficient and a second section having a second thermal expansion coefficient causing movement of the armature from the first position to the second position upon heating of the armature. Such an armature is known as a thermal bimorph actuator. As an example of materials suitable for the fabrication of the armature, the first section may be at least partially formed of permalloy whilst the second section may be at least partially formed of invar.

The bi-stable microswitch may further include a fist heating device formed on or proximate the armature. A second heating device may also be formed on or proximate the magnetisable element. One or more of the first and second heating devices may include an electrical resistance element.

Alternatively, heat may be applied to at least one of the armature and the magnetisable element by means of electromagnetic radiation. For example, microwave or other radiation may be applied by non-contact means from a remote location.

The magnetisable element may be at least partially formed from a NiCu alloy, such as thermalloy, the composition of the alloy being adjusted to set the first Curie temperature.

Conveniently, the permalloy may at least partially constitute the pair of contacts. The pair of contacts may be formed in or on an electrically isolating substrate. The magnetisable element may be formed in the substrate, and separated from the pair of contacts by an electrically isolating layer formed in or on the substrate. The pair of contacts and the magnetisable layer may be formed by micro machining techniques, involving such steps as etching or electro forming. The armature may comprise a cantilever ovehanging the pair of contacts. The armature may also be formed by micromachining techniques, such as electro forming.

Another aspect of the present invention provides an array of bi-stable microswitches as described hereabove. Each of the microswitches may be at least partly formed in a common substrate by micro machining techniques.

BRIEF DESCRIPTION OF THE DRAWINGS

The following description refers in more detail to the various features of the switching array and switching array element of the present invention. To facilitate an understanding of the invention, reference is made in the description to the accompanying drawings where the invention is illustrated in a preferred but non limiting embodiment.

In the drawings.

DETAILED DESCRIPTION OF THE INVENTION

Figure 1:
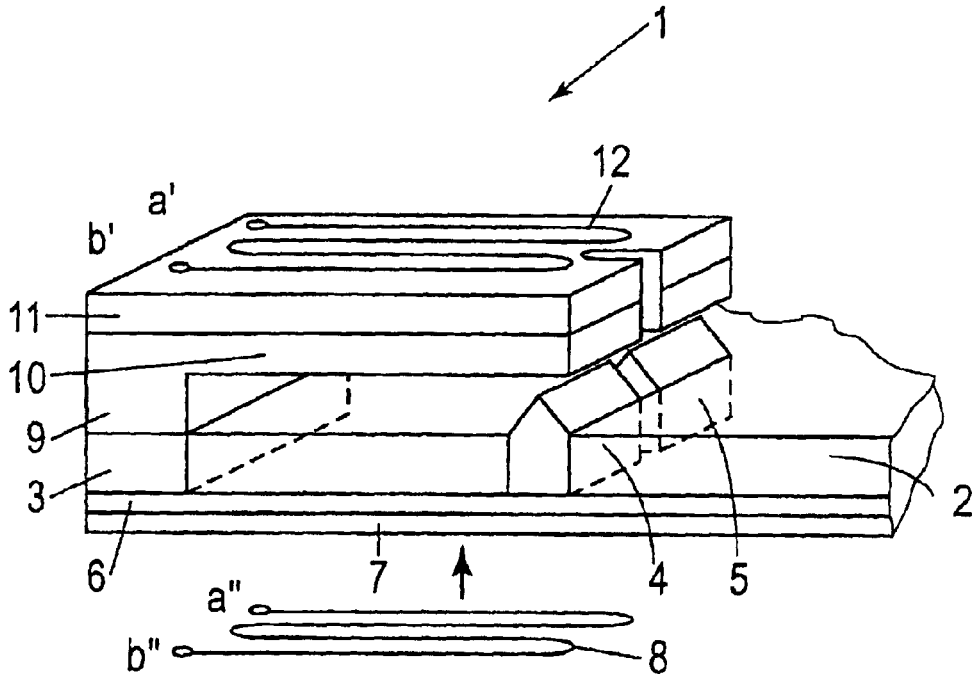
FIG. 1 is a perspective diagram illustrating one embodiment of a bi-stable microswitch according to the present invention.

Referring now to FIG. 1, there is shown generally a microswitch 1 formed in an electrically inert substrate 2, such as glass or silicon. Apertures are formed by etching or other micromachining techniques in the substrate 2. Silk screening techniques are then used to apply a slurry of magnetic particles and binding into the apertures formed in the substrate. The orientation of these magnetic particles is then fixed and the slurry set in order to form permanent magnet 3. The electro-deposited permalloy elements 4 and 5 form a pair of contacts of the microswitch 1. A coating of Au, permalloy or like material is then formed on the upper surfaces of the pair of contacts 4 and 5. It can be seen from FIG. 1 that the pair of contacts 4 and 5 project from one surface of the substrate 2.

An insulating dielectric layer 6 is then formed on the other surface of the substrate 2. The dielectric layer 6 may be formed from $SiO_2$, $SiN_2$, polyamide or like material. A layer 7 of thermalloy or other magnetisable material is then electro formed on the dielectric layer 6. The composition of the thermalloy layer 7 is adjusted to set the Curie temperature of the layer. A further dielectric layer may then be formed on the thermalloy layer 7, and electrical contacts a" and b" formed on the surface of that dielectric layer. An electrical resistance element 8, such as an NiCr heating coil, is also applied to the surface of that dielectric layer by vapour deposition or like technique.

Electro deposition techniques are then used to form a column 9 and a cantilever 10 of invar. A cantilever 11 of permalloy is then electroformed on the permalloy cantilever 10. An "adhesion" layer may be applied to the invar cantilever 10 prior to the electroforming of the permalloy cantilever 11.

Another dielectric layer may then be formed on the cantilever 11, and contacts a' and b' then formed on the upper surface of that dielectric layer. A heating coil 12 is also formed by vapour deposition on that dielectric layer.

Figure 2:
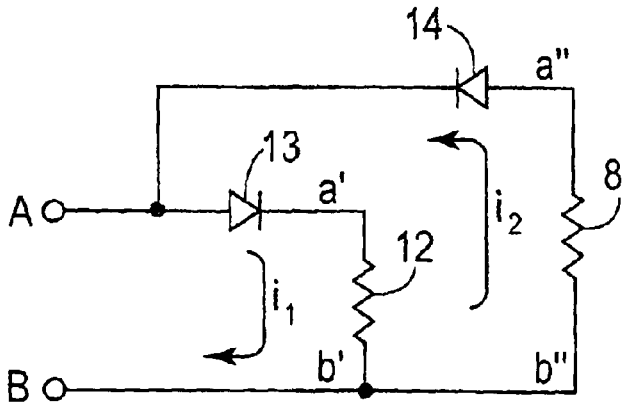
FIG. 2 is a circuit diagram showing one embodiment of a control circuit for the interconnection of two heating elements forming part of the bi-stable microswitch of FIG. 1.

The heating coils 8 and 12 may be connected in parallel as shown in FIG. 2. In this arrangement, diodes 13 and 14 are respectively connected in series with the heating coils 12 and 8 in order that the application of a positive potential difference between common terminals A and B induces the flow of electrical current in only one heating coil at a time (See FIG. 2).

The operation of the bi-stable microswitch 1 will now be explained, Initially the microswitch 1 is in the stable state shown in FIG. 1. The microswitch will remain in this state indefinitely until a positive potential difference is applied across the terminals A and B. This causes a current flow it through the heating coil 12, causing the temperature in the cantilevers 10 and 11 to rise. The invar cantilever 10 and permalloy cantilever 11 form two sections, each having a different thermal expansion coefficient from the other, of a same microswitch armature. Such an armature is known as a thermal bimorph actuator.

Due to the different thermal expansion coefficients of its two sections, the heat generated from the heating coil 12 will cause the actuator to deflect downwards until it comes into close proximity with the pair of contacts 4 and 5. This completes a magnetic circuit consisting of the permalloy/invar actuator, the permanent magnet 3, the thermalloy layer 7 and the pair of contacts 4 and 5. The inclusion of permanently magnetic material in the magnetic circuit will cause the actuator to latch into contact with the pair of contacts 4 and 5. The pair of contacts 4 and 5 will thus remain indefinitely short-circuited. It should be noted that the pair of contacts 4 and 5 are electrically isolated from the magnetic circuit by the insulating dielectric layer 6.

To release the armature, a negative potential difference is applied between the terminals A and B, thus causing the flow of a current $i_2$ through the heating coil 8. This heats the thermalloy layer 7. The thermalloy layer 7 is an alloy of NiCu whose Curie temperature can be determined by the composition of the alloy. Typically, the Curie temperature may be set at approximately 150° C. When the temperature of the thermalloy layer 7 reaches the Curie temperature, the permeability of the thermalloy layer 7 drops to unity, thus breaking the magnetic circuit. As a result, the contact latching force drops to a small value insufficient to retain the armature in contact with the pair of contacts 4 and 5. As the armature is not being heating and caused to deflect downwards, the resilient biasing of the armature towards the position shown in FIG. 1 causes the armature to return to the stable state shown in that figure.

It will be noted that the bi-stable switch 1 shown in FIG. 1 has two stable states with the pair of contacts 4 and 5 being indefinitely open in one state and indefinitely closed in the other state. It does not require the supply of electrical power in either of these two stable states. Electrical power only needs to be provided for a short period, typically a few milliseconds, to cause a transition from one state to the other. Advantageously, the magnetic latching in the closed state results in the microswitch being resistant to vibration, since the magnetic force attracting the actuator to the pair of contacts 4 and 5 increases inversely as any gap therebetween decreases.

Although the embodiment illustrated in FIGS. 1 and 2 relies upon the use of heating devices formed on or proximate the armature and the layer 7 of magnetisable material, in alternative embodiments heat may be applied to at least one of the these elements by means of electromagnetic radiation or lasers. For example, microwave or other radiation may be applied by non contact means from a remote location.

A microswitch of the type illustrated in FIG. 1 can easily be fabricated to have a "foot print" of less than 1 millimeter×5 millimeters, and is amenable to fabrication using batch processing, standard photolithography, electroforming and other micromachining processes.

Figure 3:
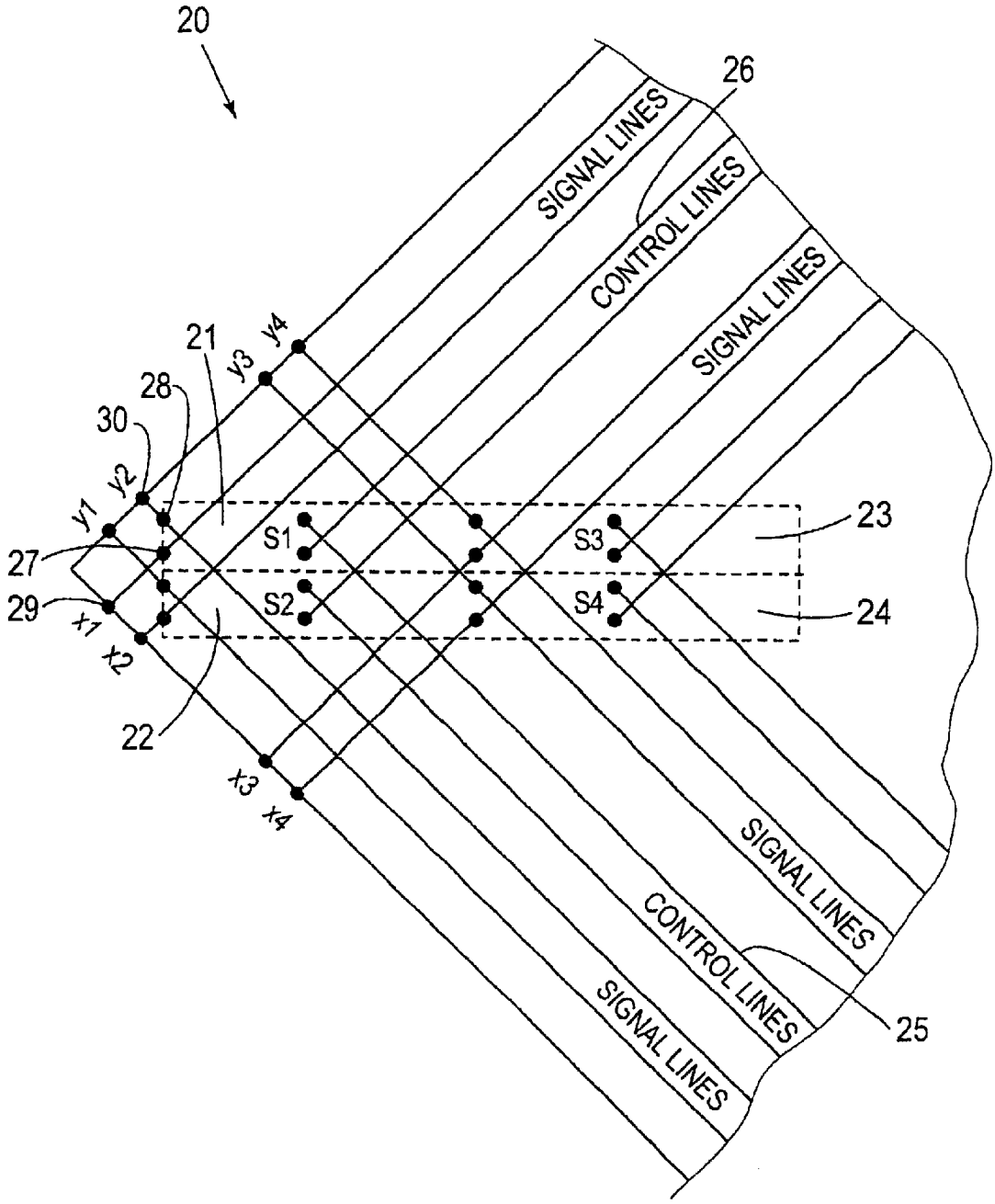
FIG. 3 is a diagram showing one embodiment of a switching array including bi-stable microswitches of the type shown in FIG. 1.

Moreover, such micromachining techniques facilitate the fabrication of a microswitch array of elements such as the microswitch illustrated in FIG. 1. FIG. 3 illustrates one example of a microswitch array 20 including bi-stable microswitch elements 21 to 24 each identical to the microswitch 1 shown in FIG. 1. In the example illustrated, control lines 25 and 26 are respectively connected to terminals A and B of the bi-stable microswitch element. Application of a potential difference between the control lines 25 and 26 in the manner described in relation to FIG. 2 causes the selective short circuiting of the pair of contacts 27 and 28, thus interconnecting signal lines 29 and 30. Other microswitch elements within the array 20 operate in a functionally equivalent manner.

Figure 4:
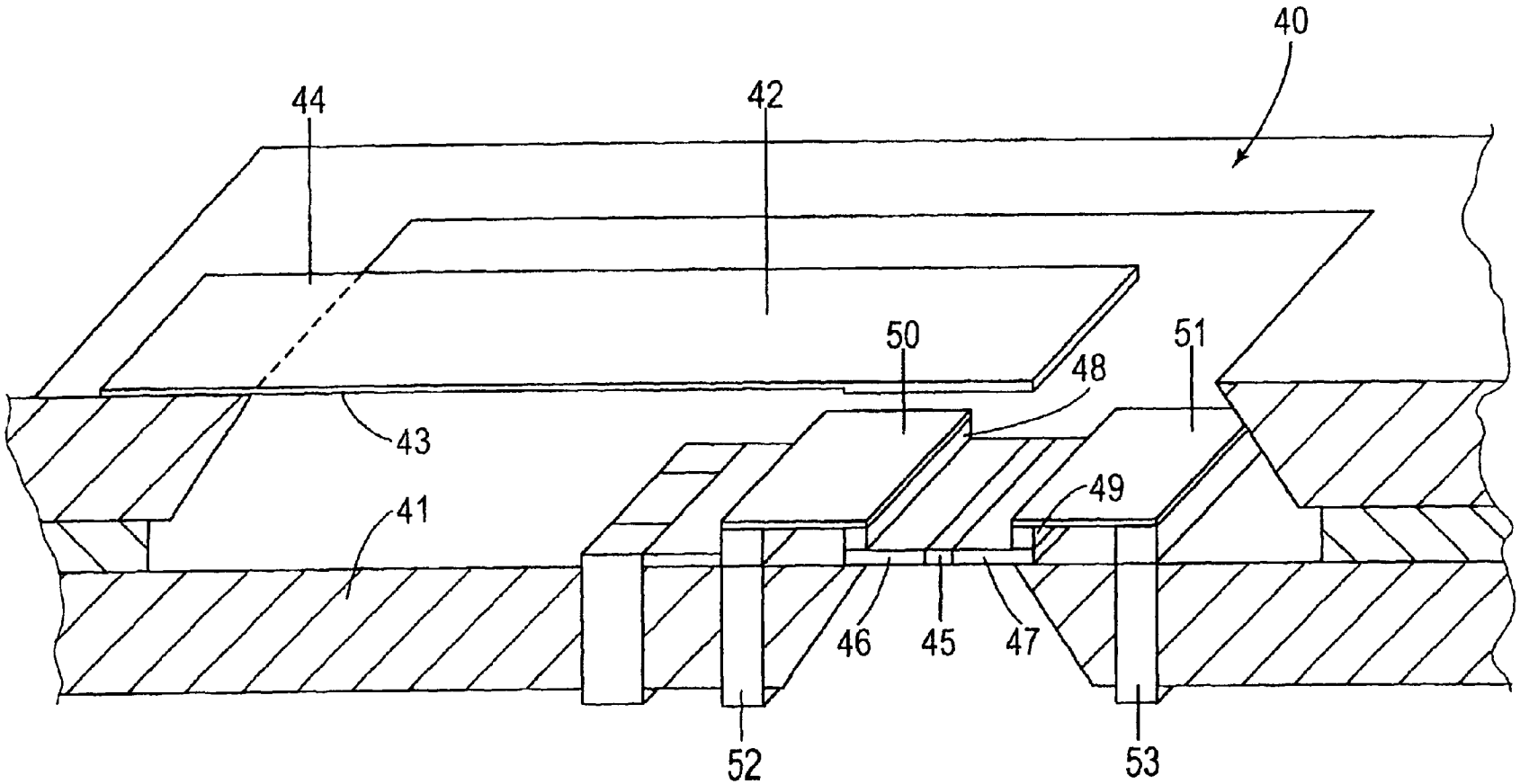
FIG. 4 is a perspective diagram illustrating a second embodiment of a bi-stable microswitch according to the present invention.

FIG. 4 shows a second embodiment of a microswitch according to the present invention. In this embodiment, a microswitch 40 is again formed in a silicon substrate 41 from micromachining techniques. The microswitch 40 includes a thermal bimorph actuator 42 comprising a first layer 43 of silicon onto which is deposited a second layer 44 of permalloy. In use, the silicon/permalloy cantilever is thermally actuated by a heating coil formed on the upper surface of the permalloy layer, as was the case in the microswitch illustrated in FIG. 1.

The microswitch 40 also includes a permanent magnet 45 interposed between two co-planar layers 46 and 47 of a thermalloy. Two columns 48 and 49 are formed at distal locations on the upper surface of the thermalloy layers 46 and 47 on either side of the permanent magnet 45.

Metallic layers 50 and 51 are respectively deposited on the upper surfaces of the permalloy columns 48 and 49. Metallic columns 52 and 53 connect the metallic layers 50 and 51 with the opposing surface of the substrate 41 in order to provide electrical connections for the microswitch 40. In addition, an electrical resistance element 8 is applied to the under surface of the microswitch 40 in order to apply heating to the thermalloy layers 46 and 47.

Heating of the bimorph actuator 42 causes the actuator to deflect downward until an end portion of the actuator 42 comes into contact with the metal surfaces directly above the permalloy columns 48 and 49. This completes a magnetic circuit consisting of the permanent magnet 45 and co-planar thermalloy layers 46 and 47, the permalloy columns 48 and 49, the metal layers 50 and 51 and the permalloy end portion of the bimorph actuator 42. It will be noted that this embodiment magnetic flux from the permanent magnet 45 no longer flows along the entire length of the cantilever, as was the case in the microswitch illustrated in FIG. 1, but only through the end portion of the cantilever. In order to release the microswitch, the thermalloy layers 46 and 47 are heated until the Curie temperature is reached, and the magnetic circuit broken, thus releasing the armature 42 which is then able to return to its at rest position as shown in FIG. 4.

Figure 5:
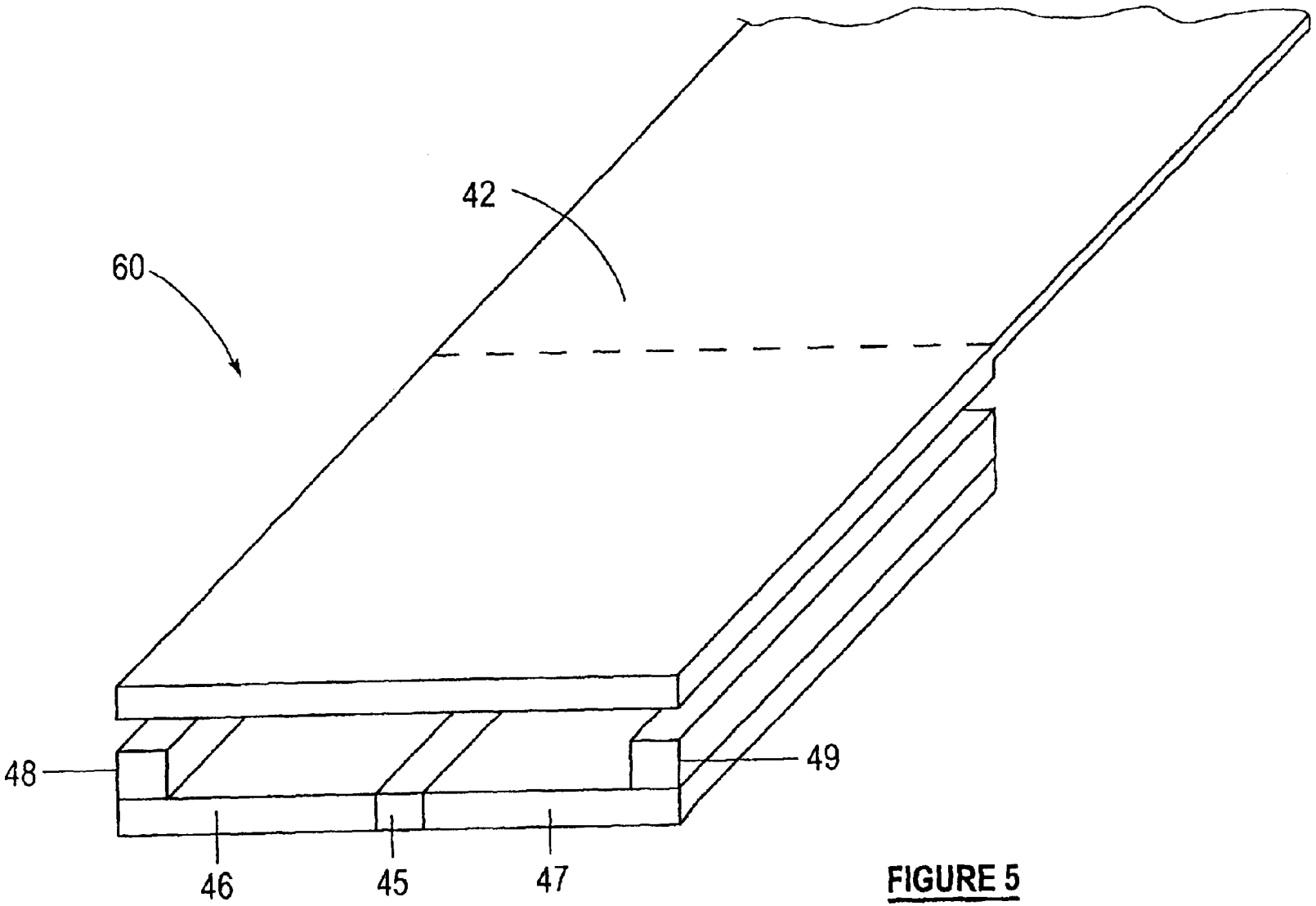
FIG. 5 is a perspective diagram illustrating a third embodiment of a bi-stable microswitch according to the present invention.

FIG. 5 shows a variant in which the orientation of the permanent magnet 45, thermalloy co-planar layers 46 and 47, and permalloy columns 48 and 49 remain the same, but the orientation of the silicon/permalloy bimorph cantilever 42, and in particular the permalloy only end portion of the cantilever 42, has been rotated through 90 degrees. Otherwise, the operation of the microswitches 40 and 60 is identical.

Figure 6:
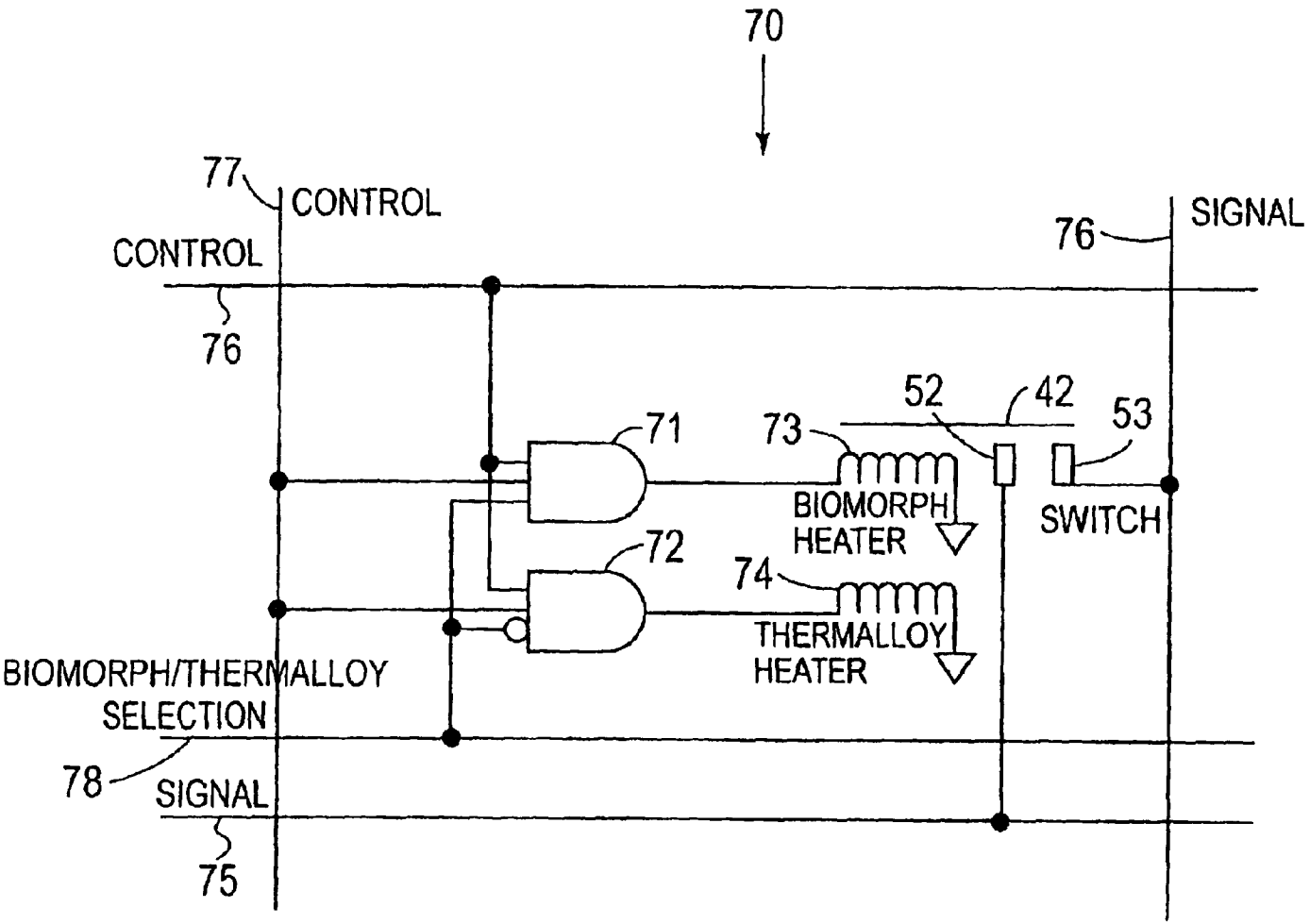
FIG. 6 is a circuit diagram showing a second embodiment of a control circuit for the control of the two heating elements forming part of the bi-stable microswitch of FIG. 1.

FIG. 6 shows a control circuit 70 for enabling selective operation of the microswitch 40. This control circuit, which can be implemented using TTL logic directly fabricated into the silicon substrate 41, includes two AND gates 71 and 72. The output of the AND gate 71 is connected to a heating coil 73 deposited on the bimorph actuator 42, whereas the output of the AND gate 72 is connected to a heating coil 74 acting to heat the thermalloy co-planar layer 46 and 47. The electrical contacts provided by the metallic columns 52 and 53 of the microswitch 40 are respectively connected to signal lines 75 and 76. The AND gate 71 includes three inputs, respectively connected to the control lines 76 and 77, and a bimorph/thermalloy selection line 78. The AND gate 72 includes three inputs, respectively connected to the control lines 76 and 77, and also an inverting input connected to the bimorph/thermalloy selection line 78.

The microswitch 70 remains in a bi-stable state controlled by the logical high or low signal of the bimorph/thermalloy selection line 78. Accordingly, upon the placement of a logically high signal on the control lines 76 and 77, and the placement of a logically high signal on the bimorph/thermalloy selection line 78, a logically high output is placed at the output of the AND gate 71, causing current to flow through the heating coil 73 and the consequent operation of the actuator 42. Accordingly, the actuator 42 is brought into contact with the two metallic contacts 52 and 53 to thereby interconnect signal lines 75 and 76.

Upon the placement of a logically low signal on the bimorph/thermalloy selection line 78, the output of the AND gate 72 goes high, and a current is caused to flow through the heating coil 74. The thermalloy layers 46 and 47 are then heated to above the Curie temperature, so that the magnetic circuit is broken and the actuator 42 caused to return to its at rest position in which contact is broken with the metallic contacts 52 and 53 and the signal line 75 and 76 are disconnect.

Figure 7:
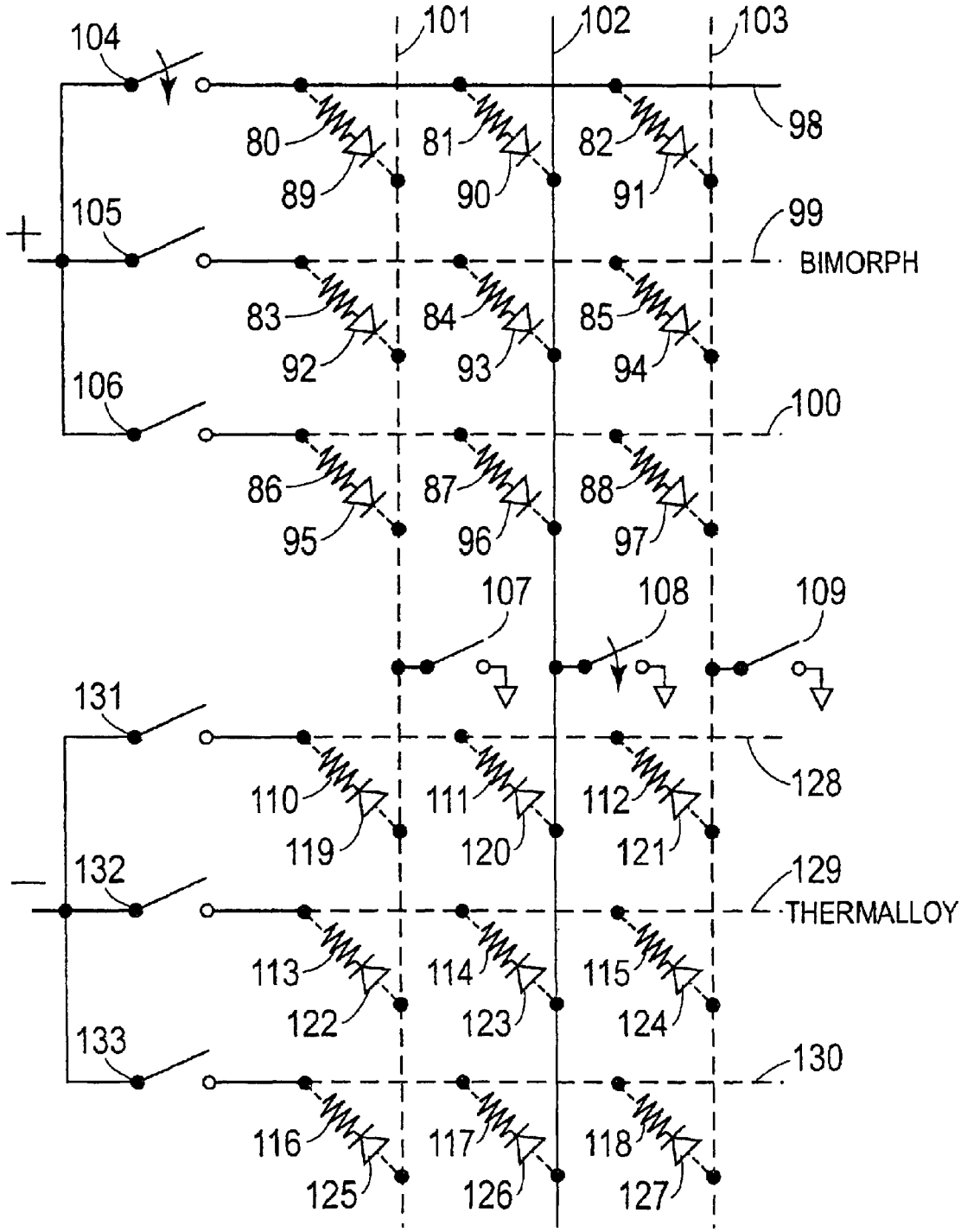
FIG. 7 is a circuit diagram showing an embodiment of an array of control circuits for control of heating elements forming part of an array of bi-stable microswitches according to the present invention.

FIG. 7 shows an implementation of the control circuit using steering diodes as shown in FIG. 2. In this arrangement, an array of healing coils 80 to 88 and associated steering diodes 89 to 97 are provided, each heating coil/diode pair acting to heat the bimorph actuator of a separate microswitch. Rows of adjacent heating coils/diode pairs are interconnected by control lines 98 to 100, whilst columns of adjacent heating coils/diode pairs are interconnected by control lines 101 to 103. Selective operation of control switches 104 to 106 in the control lines 98 to 100, and control switches 107 to 109 in the control lines 101 to 103, selectively interconnect a positive power source to ground through one of the bimorph actuator heating coils, thus causing activation of that selected actuator.

Similarly, further heating coils 110 to 118 and associated steering diodes 119 to 127 act to heat the thermalloy layers of individual microswitches in the array. Control lines 128 to 130 interconnect rows of adjacent heating coils/diode pairs, whilst columns of adjacent heating coil/diode pairs are interconnected by the control lines 101 to 103. Control switches 131 to 133 selectively connect control lines 128 to 130 to a negative power supply. Selective operation of the control switches 131 to 133 and control switches 107 to 109 cause current to flow through a selected heating coil/diode pair, and the heating of the thermalloy layers of a selected microswitch.

Finally, it is to be understood that various modifications and/or additions may be made to the microswitch array and microswitch element without departing from the ambit of the present invention described herein.

What is claimed is:

1. A bi-stable microswitch including a pair of contacts and an armature movable between a first position and a second position to selectively break or make the pair of contacts, the armature being latched in the second position by a magnetic path including a permanent magnet and a magnetisable element having a first temperature, wherein the armature is resiliently biased towards the first position when latched, and is movable from the second position to the first position upon heating of the magnetisable element to above the first temperature, wherein the armature includes a first section having a first thermal expansion coefficient and a second section having a second thermal expansion coefficient causing movement of the armature from the first position to the second position upon heating of the armature.

2. A bi-stable microswitch according to claim 1, wherein the first section of the armature is at least partially formed of permalloy.

3. A bi-stable microswitch according to claim 1, wherein the second section of the armature is at least partially formed of invar.

4. A bi-stable microswitch according to claim 1, and further including a first heating device formed on the armature.

5. A bi-stable microswitch according to claim 4 and further including a second heating device formed on or proximate the magnetisable element.

6. A bi-stable microswitch according to claim 5, wherein one or more of the first and second heating devices includes an electrical resistance element.

7. A bi-stable microswitch including a pair of contacts and an armature movable between a first position and a second position to selectively break or make the pair of contacts, the armature being latched in the second position by a magnetic path including a permanent magnet and a magnetisable element having a first temperature, wherein the armature is resiliently biased towards the first position when latched, and is movable from the second position to the first position upon heating of the magnetisable element to above the first temperature, wherein heat is applied to at least one of the armature and the magnetisable element by means of electromagnetic radiation.

8. A bi-stable microswitch according to claim 7, wherein microwave or other radiation is applied by non-contact means from a remote location.

9. A bi-stable microswitch including a pair of contacts and an armature movable between a first position and a second position to selectively break or make the pair of contacts, the armature being latched in the second position by a magnetic path including a permanent magnet and a magnetisable element having a first temperature, wherein the armature is resiliently biased towards the first position when latched, and is movable from the second position to the first position upon heating of the magnetisable element to above the first temperature, wherein the magnetisable element is at least partially formed from a NiCu alloy, the composition of the alloy being adjusted to set the first temperature.

10. A bi-stable microswitch according to claim 1, wherein the pair of contacts are formed in or on an electrically isolating substance.

11. A bi-stable microswitch according to claim 10, wherein the magnetisable element is formed in the substrate, and separated from the pair of contacts by an electrically isolating layer formed in or on the substrate.

12. A bi-stable microswitch according to claim 11, wherein the pair of contacts and the magnetisable layer are formed by micro machining techniques.

13. A bi-stable microswitch including a pair of contacts and an armature movable between a first position and a second position to selectively break or make the pair of contacts, the armature being latched in the second position by a magnetic path including a permanent magnet and a magnetisable element having a first temperature, wherein the armature is resiliently biased towards the first position when latched, and is movable from the second position to the first position upon heating of the magnetisable element to above the first temperature, wherein the armature comprises a cantilever overhanging the pair of contacts.

14. A bi-stable microswitches according to claim 13, wherein the armature is formed by micromachining techniques.

15. An array of bi-stable microswitches, each microswitch having features according to claim 1.

16. An array of bi-stable microswitches according to claim 15, wherein each of the microswitches at least partly formed in a common substrate by micro machining techniques.

17. A bi-stable microswitch according to claim 9, further comprising a first heating device formed on the armature.

18. A bi-stable microswitch according to claim 13, further comprising a first heating device formed on the armature.

* * * * *